United States Patent [19]

Maddox

[11] Patent Number: 4,528,556

[45] Date of Patent: Jul. 9, 1985

[54] DEFECTIVE MOTOR BRUSH DETECTOR

[75] Inventor: Edward L. Maddox, Lexington, Mass.

[73] Assignee: Leesona Corporation, Warwick, R.I.

[21] Appl. No.: 465,835

[22] Filed: Feb. 14, 1983

[51] Int. Cl.[3] ..... G08B 21/00

[52] U.S. Cl. ..... 340/648; 310/245

[58] Field of Search ..... 340/635, 648; 310/242, 310/245, 246, 248, 251

[56] References Cited

U.S. PATENT DOCUMENTS

| | | | |
|---|---|---|---|
| 4,024,525 | 5/1977 | Baumgartner et al. | 340/648 X |
| 4,316,186 | 2/1982 | Purdy | 340/648 |
| 4,333,095 | 6/1982 | Silva | 340/648 X |

OTHER PUBLICATIONS

"Current Indicator is Overload Proof" by Henno Normet, *Electronics*, 1/6/1977, p. 114.

*Primary Examiner*—James L. Rowland
*Assistant Examiner*—Jeffery A. Hofsass
*Attorney, Agent, or Firm*—B. W. Norton

[57] ABSTRACT

This invention relates to apparatus for detection and monitoring of improper operation of commutator-brush combinations conveying current to or from the electromagnetic rotary member of a motor or generator, and relates, more particularly, to means for detecting defective brushes in critical motor driven textile units such as yarn storage feeder devices which operate to store yarn temporarily for use by user means such as a loom.

10 Claims, 3 Drawing Figures

DEFECTIVE MOTOR BRUSH DETECTOR

BACKGROUND OF THE INVENTION

In motors and generators employing electromagnetic rotors which are connected by commutator brushes to a power source or load, the brushes, usually carbon, may wear or fracture resulting in poor performance or in motor or generator failure. Particularly in the case of d-c motors used in variable speed drive of critical systems elements, the consequential damages of inadequate motor performance can be significant and, in fact, cause commutator destruction. By way of one example, in the art of weaving it is well known to provide a weft or filling yarn storage feeder device, referred to herein simply as a "yarn feeder", which operates to store yarn for use by a loom, normally a shuttleless loom. The device includes a yarn collecting drum on which weft yarn from a supply source is wound temporarily and then removed under controlled, uniform tension for delivery to the loom. Such devices eliminate the wide variations in yarn tension which occur when yarn is delivered from a supply source such as a cone or package, and permits the yarn to be fed to the loom under substantially constant tension. This art is exemplified by U.S. Pat. No. 3,776,480 to John B. Lawson granted Dec. 4, 1973 and U.S. Pat. No. 3,853,153 granted Dec. 10, 1974 to A. H. Van Duyhoven et al. Typically, such yarn feeders may have either a rotary drum upon which the yarn is wound as the drum is driven by a suitable motive source such as an electric motor or the feeders may incorporate a stationary drum with an orbiting flyer driven by, say, an electric motor and engaging the welft yarn to apply it to the surface of the stationary drum. If the yarn feeder is not operated at proper start or stop time or at proper speed the critical yarn feed mechanism is likely to cause shutdown of the machinery because of jamming or improper yarn feed.

Motor operation monitors of the prior art were not practically operable in such textile systems because in essence the prediction of erratic operation or motor failure was not feasible. There have been brush wear indicators which switched on alarm circuits when the brush has worn a predetermined amount. These characteristically require physical modification of the brush holder or the brush itself to add a sensing switch or contact. However, these prior art indicators could not indicate fractured brushes, mispositioned brushes or other brush-commutator indications of erratic motor operation, exhibition of which is desirable to prevent down time in the textile machine and the like.

Examples of these brush wear detectors and monitors are found in the following U.S. Patents, U.S. Pat. No. 4,121,207 issued Oct. 17, 1978 to F. L. Jones; U.S. Pat. No. 4,316,186 issued Feb. 16, 1982 to J. A. Purdy et al; U.S. Pat. No. 4,024,525 issued May 17, 1977 to K. A. Baumgartner et al; and U.S. Pat. No. 3,523,288 issued Aug. 4, 1970 H. A. Thompson.

Other objects, features and advantages will be found throughout the description, claims and drawings.

It is therefore an object of this invention to produce improved systems for detecting and monitoring erratic operation of brush and commutator connected electromagnetic rotating machinery such as d-c motors and generators to predict and resolve failure before consequential damages from the failure result.

SUMMARY OF THE INVENTION

In accordance with this invention erratic motor behavior anticipatory of failure is indicated by detection of abnormal current flow through the rotary electromagnetic member, typically a d-c motor armsture. Thus, if a brush is worn or fractured, the spring pressure is improper, or the brush should become jammed, current flow becomes abnormal, and sparking may occur.

It is necessary to distinguish abnormal current from proper rotor operation and to detect it easily. If the current flow through the commutator-brush assembly is used as a monitoring medium then the various normal current fluctuations caused from electromagnetic fields must be ignored. These, however, occur at the rotating speed of the armature poles or the first few harmonics thereof. By contrast the abnormal current includes impulse type signals occuring in a frequency range significantly higher than the rotation frequency of the armature. Thus, by coupling only the armature current signals of high frequency into a detector monitor control system, the abnormal current at the commutator can give a prediction of coming motor failure at an early enough time to introduce planned maintenance and thereby significantly reduce consequential damages such as motor failure or defects in fabrics or snarled yarn in a textile machinery environment.

DESCRIPTION OF THE PREFERRED EMBODIMENTS

Figure 1:
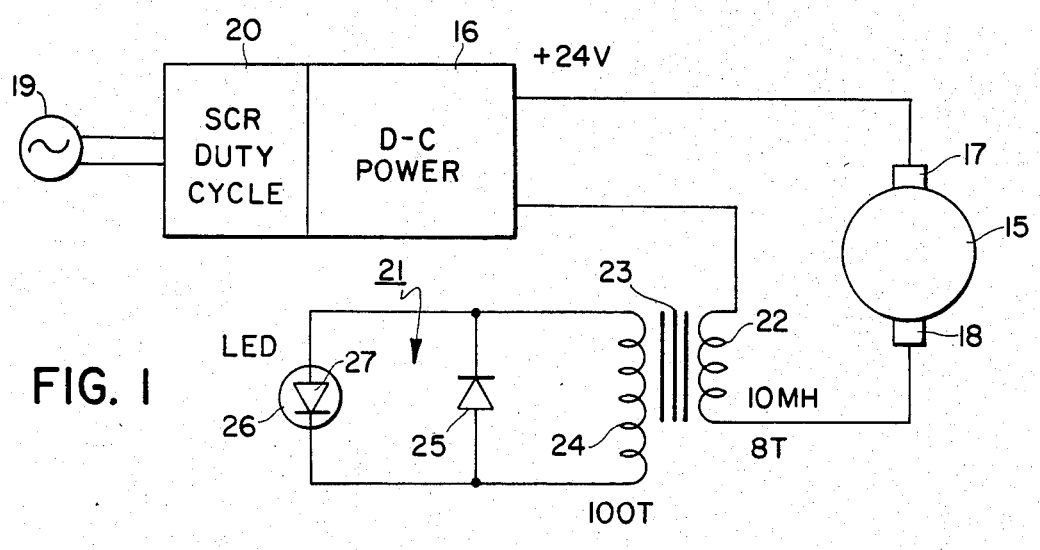
FIG. 1 is a simplified schematic diagram, partly in block diagram form, of the commutator misfunction detection and monitoring system afforded by this invention.

A system is shown in FIG. 1 for detecting and monitoring erratic operation of the rotary electromagnetic armature of a d-c motor 15 coupled to a variable voltage d-c power soruce 16 by means of the brush-commutator (or slipring) assemblies 17, 18. The d-c power source rectifies and filters current from an a-c power line source 19 by means of a silicon controlled rectifier duty cycle control circuit 20. Other conventional power supplies including batteries could be used. In accordance with the present invention motor 15 may be alternatively a series-wound universal a-c/d-c motor operable from an a-c power source, or another device having a rotary electromagnetic member coupled to a power source by a brush and commutator or slipring such as a generator.

Erratic behavior of motor 15 precedes motor failure and is indicated when abnormal current occurs such as from weak or improperly operating brush bias springs or nearly worn out brushes, etc. This abnormal current, is accompanied by high frequency impulses and thus, in accordance with the present invention is separated from any lower frequency electromagnetic waves occuring in normal operation of the motor by the build up or collapse of electromagnetic fields as the rotor rotates.

These lower frequency waves, which will be excluded from the detector afforded by this invention, are a function of the fundamental frequency and first few harmonics determined by the rotating armature poles and is limited to a low frequency band generally under 10,000 Hz.

The high frequency band impulse signal detector thus comprises the transformer coupled detector-monitor circuit 21. The series connected primary winding 22 of transformer 23 has about 8 turns producing approximately 10 micro henries inductance to respond to and couple into secondary winding 24 (typically of 100 turns) only those signal impulses of significantly higher frequency content than the armature rotation component frequencies.

The detector arrangement has a threshold detection circuit responsive to the magnitude of the high frequency signals exceeding a predetermined value. This threshold value can be set at a value consistent with the sensitivity of a particular system to erratic motor operation and the need to prevent signals or alarms before a significant danger of failure is encountered.

One simple threshold detector-monitor circuit includes a diode rectifier 25 and a light emitting diode (LED) 26 which becomes visibly lighted at a threshold value indicating the presence of frequently recurring abnormal current impulses predicting the motor failure, such as occur for example when the brushes become worn enough to require replacement. Normal electromagnetic inductive currents from motor operations will not produce enough signal in secondary winding 24 to exceed the threshold and, therefore, will not light the LED. The earliest indications of brush contact failure will cause intermittent lighting of the LED, and become more frequent and steady with further brush contact deterioration.

The polarity of diode 25 is pertinent when the SCR control circuit 20 is used. A positive potential is produced a LED anode 27 for decreases in motor current. Thus, the sharp increase in current (high frequency impulse) when the SCR is turned on is short circuited by diode rectifier 25 and will not harm or actuate the LED.

Figure 2:
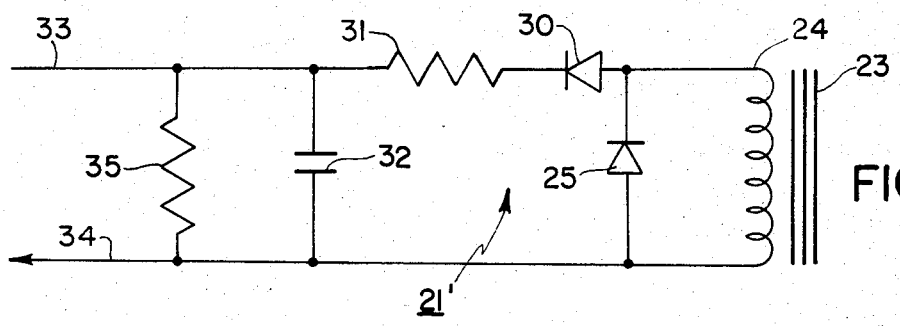
FIG. 2 is a partial schematic diagram portion of a further detection and monitoring embodiment of the invention useful for remote indication and control purposes.

The detector circuit portion 21'of FIG. 2 is an alternative detector-monitor circuit which provides a d-c signal useful for control systems or for actuating remote visual monitors. The threshold effect is provided by the forward voltage drop of diode 30 and resistor 31. When the abnormal current impulses are of great enough magnitude and occur frequently enough, a voltage will be established across capacitor 32 which can be conveyed over wire connections 33 and 34 and used to operate an indicator or control circuit. Resistor 35 serves to discharge capacitor 32 when there is no fault signal.

Figure 3:
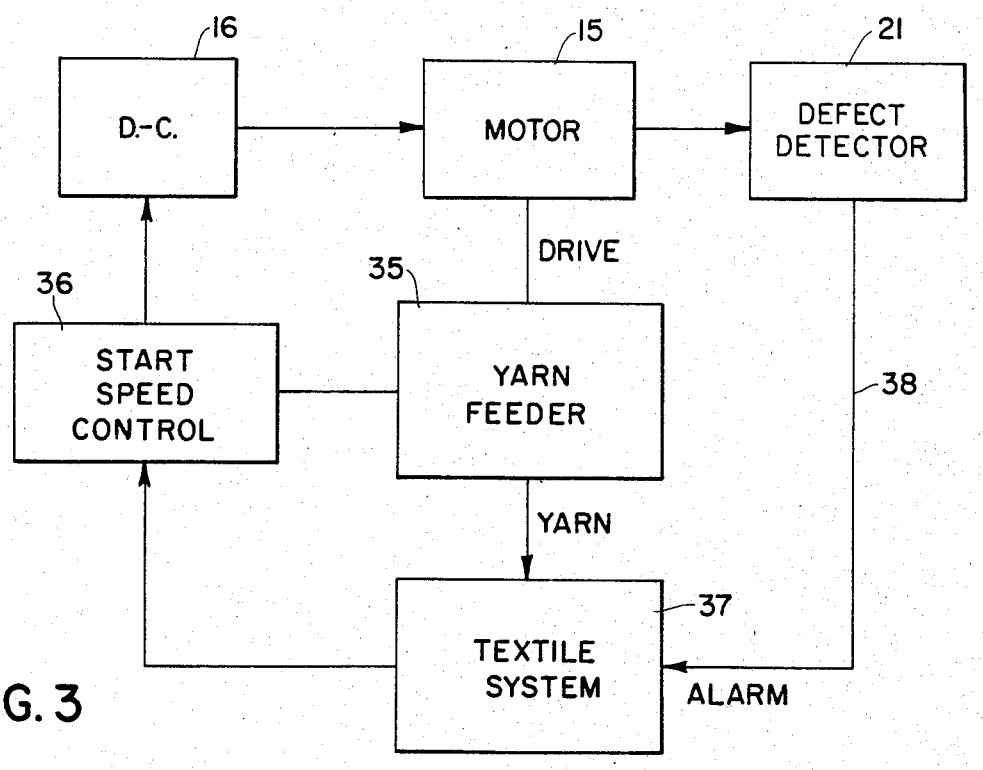
FIG. 3 is a system block diagram of a typical textile machine installation control circuit system for reducing consequential damages due to motor failure in accordance with the invention.

The block diagram of FIG. 3 represents a typical control circuit system for a textile machinery environment in which the misfunction detector of the present invention serves to predict potential near-term motor failure and thereby prevent such erratic motor operation as to interfere with yarn storage or fabric production. In such systems, the start up and/or speed of yarn feeder 35 as driven by the d-c motor 15 is speed controlled at 36 to deliver yarn in accordance with the needs of the textile system 37. Except to the extent of the improvements herein set forth yarn feeder 35 may, in general, be the same as is disclosed in prior cited U.S. Pat. No. 3,776,480 which is herein incorporated by reference.

As hereinbefore discussed the defect detector-monitor circuit 21 may then provide control signals at lead 38 for suitable alarm control of the textile system 37 for example, a loom, and therefore the motor 15 and yarn feeder 35 interconnected in the system. Thus, a monitor light showing motor maintenance should be scheduled can be used as indicated in FIG. 1. Alternatively a circuit as shown in FIG. 2 may be used to shut down or modify operation of the textile system to prevent consequential damage such as by yarn snarling or breakage or fabric defects when the misfunction signals exceed a predetermined level.

It is therefore evident that this invention has advanced the state of the art by the provision of improved malfunction sensors and indicators and in the interaction of motor drive in critical textile machinery operation. Therefore those novel features believed descriptive of the nature and spirit of the invention are defined with particularity in the claims.

What is claimed is:

1. Apparatus for detecting and indicating faulty operation of an electric motor or generator provided with brush type sliding contacts coupling said motor or generator to a source of power comprising, current sensing means including the primary of a transformer connected between said source of power and said contacts and operable to derive impulse type signals caused by faulty operation of said contacts, and signal means connected to said current sensing means and actuated in response to said impulse type signals to provide an output signal.

2. Apparatus as set forth in claim 1 including a threshold detection circuit connected with said current sensing means for controlling operation of said signal means only in the presence of impulse type signals exceeding a predetermined value.

3. Apparatus as set forth in claim 2 wherein said current sensing means is operable to exclude frequency waves generally below 10,000 Hz from said detection circuit.

4. Apparatus as set forth in claim 1 wherein said electric motor or generator is of direct current type and including means for providing polarity discrimination whereby the polarity generated by circuit interruption will actuate said signal means.

5. Apparatus as set forth in claim 1 wherein said output signal is an electrical signal.

6. Apparatus as set forth in claim 5 wherein said signal means includes a detector diode to produce a unipolar electrical output and a threshold effect is provided by the forward voltage drop of said detector diode.

7. Apparatus as set forth in claim 4 wherein polarity discrimination is provided by a diode detector.

8. Apparatus as set forth in claim 4 wherein polarity discrimination is provided by the diode property of a light emitting diode.

9. Apparatus as set forth in claim 1 wherein said signal means produces a visual output.

10. Apparatus as set forth in claim 9 wherein the visual output is generated by a light emitting diode and a threshold effect is provided by the forward voltage drop of said light emitting diode.

* * * * *